US007240506B2

(12) United States Patent
Grassmuck et al.

(10) Patent No.: US 7,240,506 B2
(45) Date of Patent: Jul. 10, 2007

(54) ILLUMINATED CANOPY FOR A REFRIGERATED DISPLAY CASE

(75) Inventors: Michael D. Grassmuck, Chesterfield, MO (US); Oswaldo Carrillo, General Escobedo (MX)

(73) Assignee: Hussmann Corporation, Bridgeton, MI (US)

( * ) Notice: Subject to any disclaimer, the term of this patent is extended or adjusted under 35 U.S.C. 154(b) by 116 days.

(21) Appl. No.: 11/118,215

(22) Filed: Apr. 29, 2005

(65) Prior Publication Data

US 2006/0242981 A1 Nov. 2, 2006

(51) Int. Cl.
*A47F 3/04* (2006.01)

(52) U.S. Cl. ..... 62/249; 62/264; 362/125; 362/365

(58) Field of Classification Search ..... 62/246–256, 62/264; 362/362–365, 125
See application file for complete search history.

(56) References Cited

U.S. PATENT DOCUMENTS 1,776,789 A * 9/1930 Gloekler ..... 62/249
2,351,335 A * 6/1944 Holmes ..... 362/125
2,531,506 A * 11/1950 Geneck ..... 62/247
4,537,040 A * 8/1985 Ibrahim ..... 62/186
6,351,964 B1 * 3/2002 Brancheau et al. ..... 62/249

FOREIGN PATENT DOCUMENTS

JP 404060376 A * 2/1992

OTHER PUBLICATIONS

Refrigerated Display Case with Dedicated Lighting—Illustrated in the attached drawing and described in the attachment entitled "Statement of Relevance", admitted prior art.

* cited by examiner

*Primary Examiner*—William E. Tapolcai
(74) *Attorney, Agent, or Firm*—Michael Best & Friedrich LLP

(57) ABSTRACT

A refrigerated display case including a case that defines a product display area adapted to support and display food product to be visible from the front of the case. The case includes a canopy positioned above the product display area with at least one display panel. A refrigeration system supplies refrigerated air to the product display area and is adapted to maintain the food product at a desired temperature. A light source supported by the case projects light along a first path of illumination directed toward the product display area adapted to brighten the food product and projects light along a second path of illumination directed toward the display panel. At least a portion of the light along the second path of illumination passes through the display panel to be visible from the front of the display panel.

19 Claims, 7 Drawing Sheets

ILLUMINATED CANOPY FOR A REFRIGERATED DISPLAY CASE

BACKGROUND

The present invention relates to refrigerated display cases and, more particularly, to illuminated canopies for refrigerated display cases.

Refrigerated display cases generally include a case defining a product display area for supporting and displaying food products to be visible and accessible through an opening in the front of the case. Refrigerated display cases are generally used in retail food store applications such as grocery or convenience stores or other locations where food product is displayed in a refrigerated condition.

The case includes a top portion, typically referred to as a canopy, located above the opening to the product display area. Some refrigerated display cases include a night curtain that is mounted within the canopy. The night curtain is a thin sheet of flexible material that is adjustable between retracted and lowered positions. In the retracted position, the curtain is rolled within the canopy onto a roll and hidden from view from the front of the refrigerated display case. In the lowered condition, the curtain is unrolled from the roll away from the canopy and toward the bottom of the opening such that the drawn curtain at least partially covers the opening to the product display area. Generally, the curtain is drawn to the lowered position to better isolate the cooled air of the product display area from the ambient air outside of the refrigerated display case. The curtain improves the efficiency of the refrigerated display case while maintaining the food product at the desired temperature when the retail food store is closed (e.g., during nighttime hours), when convenient access to the food products of the product display area is not required.

Most refrigerated display cases include a dedicated first light source that is located below the canopy to illuminate the food products within the product display area. These refrigerated display cases can also include display panels on the front of the canopy. The display panels can be illuminated from behind by a separate, dedicated light source positioned behind the display panels and within the canopy.

SUMMARY

In one embodiment, the invention provides a refrigerated display case for maintaining food product at a desired temperature. The refrigerated display case includes a case, a refrigeration system, and a light source. The case includes a product display area adapted to support and display the food product to be visible from the front of the case. The case also includes a canopy positioned above the product display area with at least one display panel. The refrigeration system supplies refrigerated air to the product display area and is adapted to maintain the food product at the desired temperature. The light source is supported by the case between the product display area and the display panel. The light source projects light along a first path of illumination directed toward the product display area adapted to brighten the food product and projects light along a second path of illumination directed toward the display panel. At least a portion of the light along the second path of illumination passes through the display panel to be visible from the front of the display panel.

In another embodiment, the invention provides a refrigerated display case including a case, a refrigeration system, a light source, and a curtain. The case includes a product display area adapted to support and display the food product to be visible and accessible from an opening in the front of the case. The case also includes a canopy positioned above the product display area with at least one display panel. The light source is supported by the case and projects light along a path of illumination directed toward the display panel. At least a portion of the light along the path of illumination passes through the display panel to be visible from the front of the display panel. The curtain is coupled to the case and is adjustable between a raised position where the curtain is rolled and out of the path of illumination and a lowered position where the curtain is unrolled and within the path of illumination between the light source and the display panel. The curtain covers a portion of the opening to the product display area when the curtain is in the lowered position.

In yet another embodiment, the invention provides a refrigerated display case including a case, a refrigeration system, a light source, and a curtain. The case includes a canopy positioned above a product display area with at least one display panel. The light source is supported by the case between the product display area and the display panel. The light source projects light along a first path of illumination directed toward the product display area adapted to brighten the food product and projects light along a second path of illumination directed toward the display panel. At least a portion of the light along the second path of illumination passes through the display panel to be visible from the front of the display panel. The curtain is coupled to the case and is adjustable between raised and lowered positions. In the raised position the curtain is rolled and out of the second path of illumination. In the lowered position the curtain is unrolled, is within the second path of illumination between the light source and the display panel, and covers a portion of the opening to the product display area.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
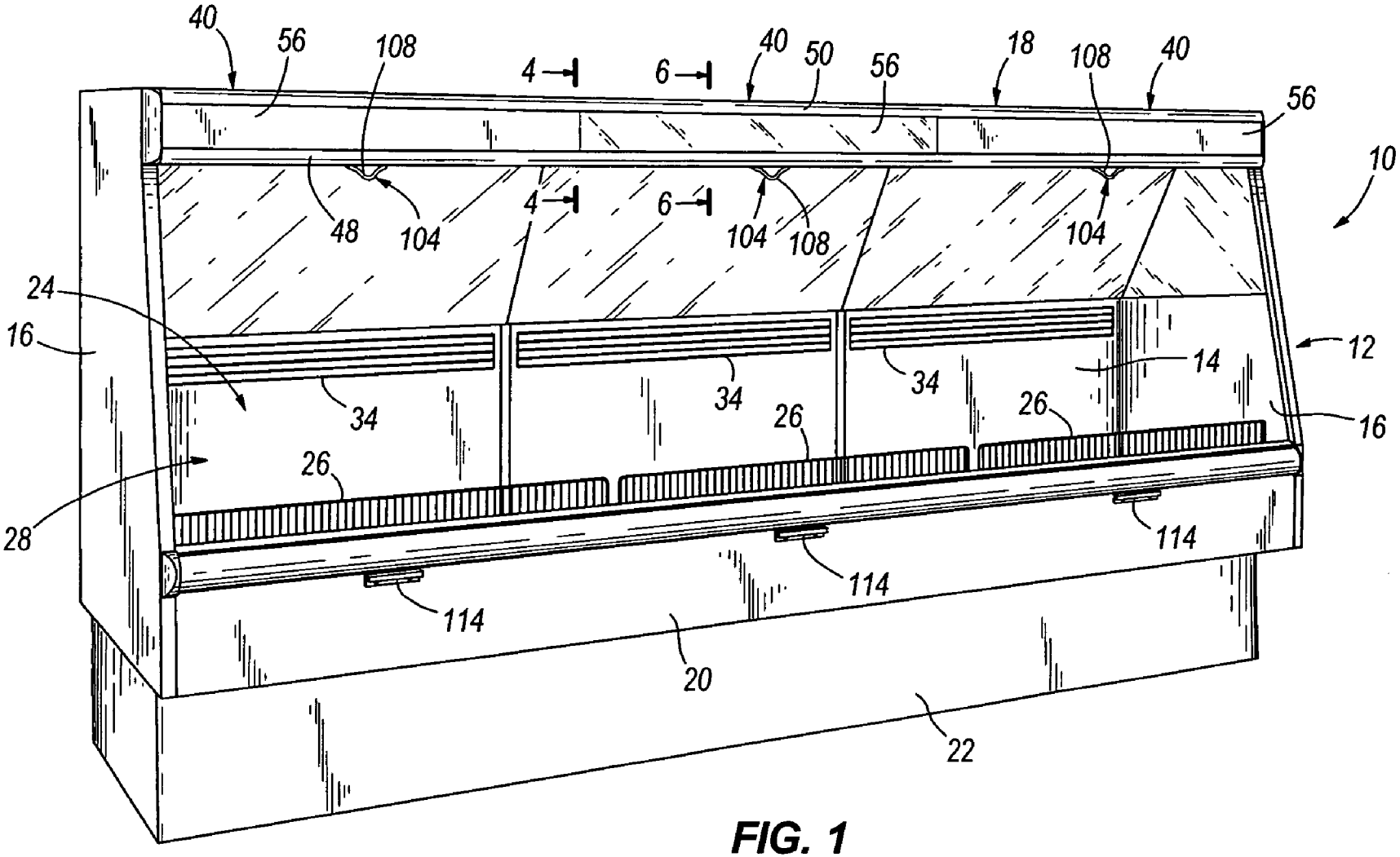
FIG. 1 is a perspective view of a refrigerated display case according to one embodiment of the invention

FIG. 1 illustrates a refrigerated display case 10 according to one embodiment of the present invention. The illustrated refrigerated display case 10 is known as a single or multi-deck merchandiser. The present invention is not limited to use with this type of merchandiser, but can also be used on other cases that support, display, and maintain food products at a desired temperature. The refrigerated display case 10 includes a case 12 that includes a rear wall 14, side walls 16 coupled to opposite edges of the rear wall 14, a top wall 18 coupled to the upper edges of the rear and side walls 14, 16, and a front wall 20 coupled between the forward edges of the side walls 16. The case 12 is supported above a support surface by a base 22. The case 12 includes a product display area 24 defined at least in part by the interior portions of the front wall 20, side walls 16, rear wall 14, and top wall 18. The product display area 24 supports and displays food product within the case 12. For example, food product can be displayed on wire racks 26 supported at the bottom of the product display area 24. In other embodiments, the food product can be supported on a shelf coupled to and extending forwardly from the rear wall 14. An opening 28 is defined between the canopy 18 and the front wall 20 and between the front edges of the side walls 16. The opening 28 allows convenient access to the product display area 24.

The refrigerated display case 10 includes a refrigeration system (not shown) that provides refrigerated airflow to the product display area 24. Although not shown, the refrigeration system generally includes an evaporator located within an air passageway internal to the case 12. Remotely located compressors compress a gaseous refrigerant and direct the compressed refrigerant to an exterior condenser where the refrigerant is cooled and condensed into a liquid refrigerant that is directed to the evaporator. Prior to reaching the evaporators, the liquid refrigerant is forced through an expansion valve converting the refrigerant into a two-phase fluid. The two-phase refrigerant absorbs heat from air being directed though the evaporator by a fan. The refrigerant generally leaves the evaporator in a superheated condition and is routed back to the compressor for recycling. The cooled air exiting the evaporator is directed through the remainder of the air passageway and is introduced into the product display area through an outlet 30 (FIGS. 4–6) located in the top wall 18 of the case 12. The outlet 30 includes a honeycomb insert 32 (FIGS. 4–6) to direct the air into the product display area 24 where it will remove heat from the displayed food products and maintain the food products at the desired temperature. A portion of the cooled air can be directed from the air passageway, through the rear vents 34 (FIG. 1), and into the product display area 24. After being circulated through the product display area 24, the warmed air is routed back into the air passageway through an inlet 36 (FIG. 11) located in a forward portion of the product display area 24. The inlet 36 is covered with a grill 38 (FIG. 11) to prevent debris from entering into the air passageway. Moving air from the outlet 30 in the top wall 18 to the inlet 36 creates an air curtain across the opening 28 separating the cooled air of the product display area 24 from the ambient air outside the case 12. The air returning into the air passageway is again circulated through the evaporator by the fan.

Figure 2:
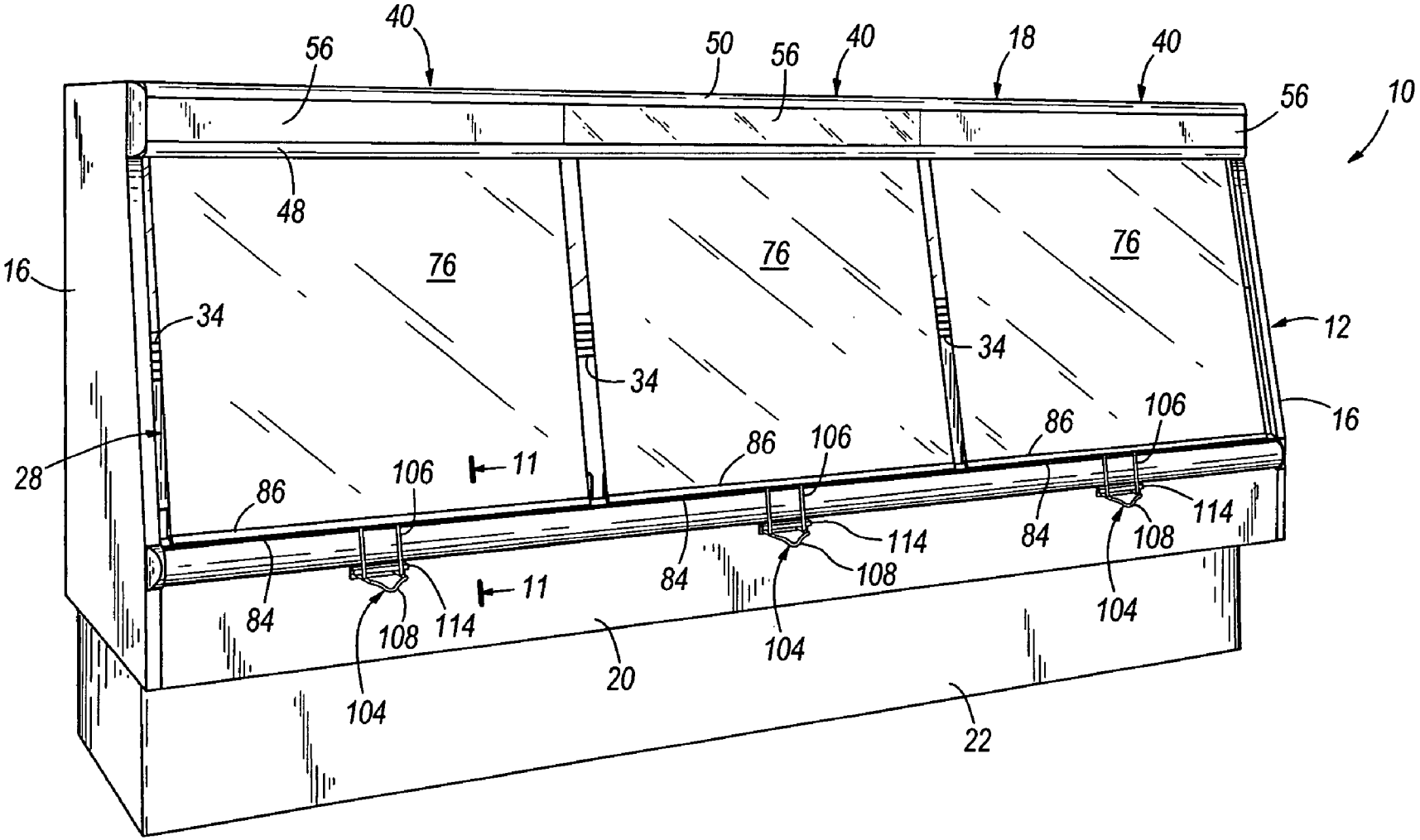
FIG. 2 is view similar to FIG. 1, illustrating night curtains of the refrigerated display case drawn to lowered positions.

As shown in FIGS. 1 and 2, the refrigerated display case 10 is constructed by assembling three separate segments 40. The segments 40 are substantially the same length and are connected to each other in a row to form a refrigerated display case 10 having a desired length. Some of the components of the refrigerated display case 10 can be segmented while others can be a single piece extending the length of the case 12.

Figure 3:
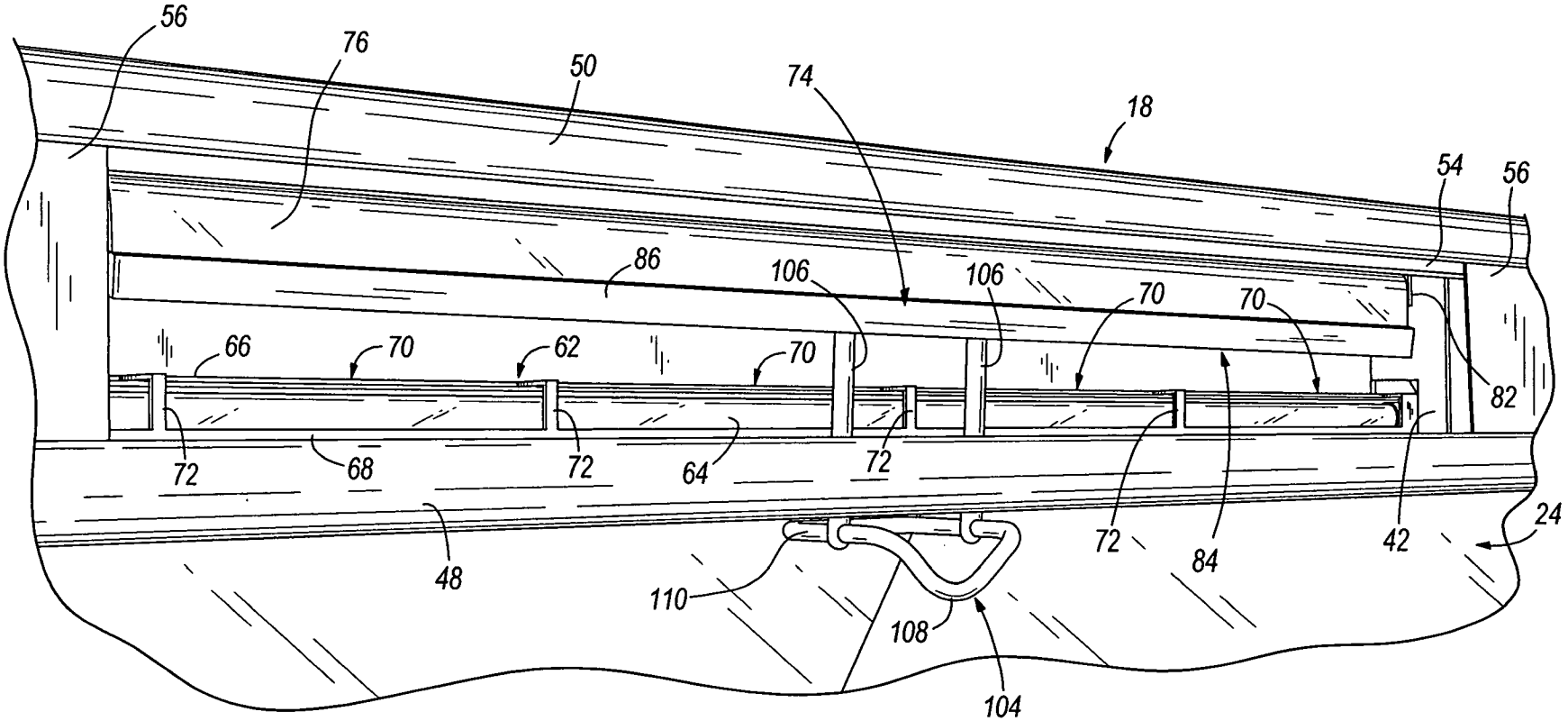
FIG. 3 is an enlarged perspective view of a canopy of the refrigerated display case of FIG. 1 illustrating a display panel of the canopy removed.
Figure 4:
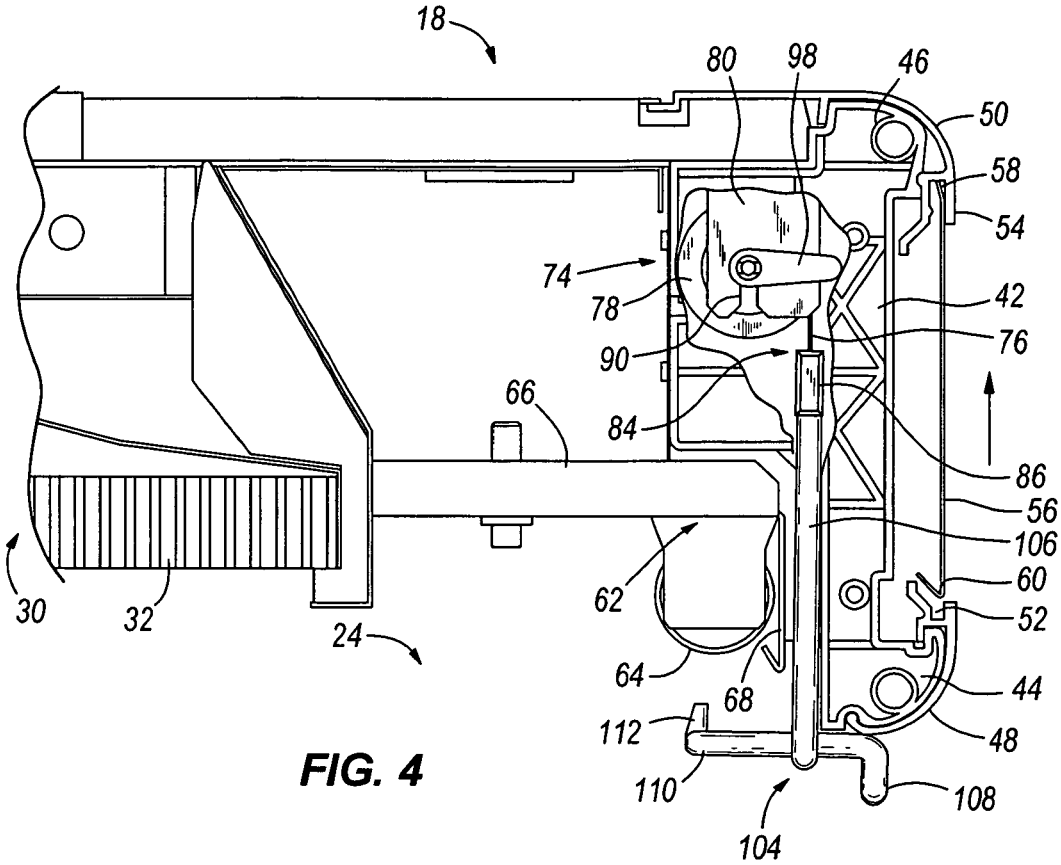
FIG. 4 is an enlarged partially cut-away cross-section view taken along line 4—4 in FIG. 1, illustrating the display panel moved upwardly.
Figure 5:
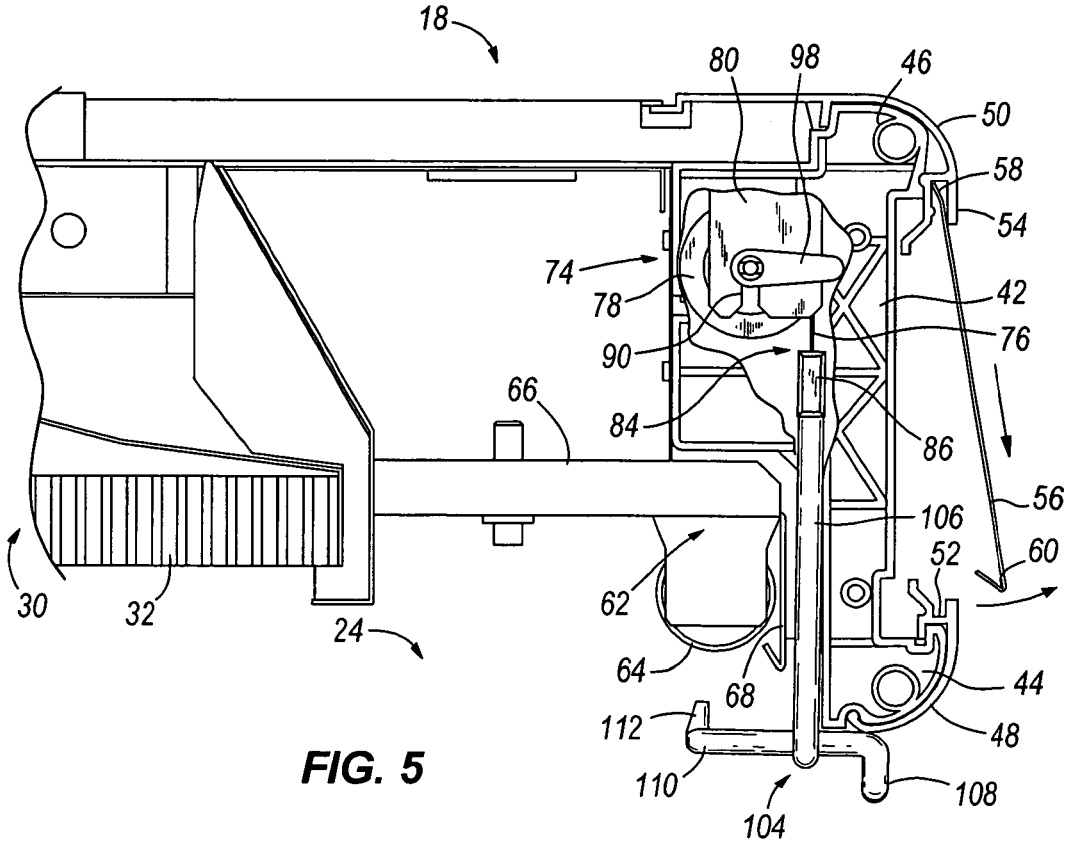
FIG. 5 is a view similar to FIG. 4, illustrating the display panel pivoted outwardly.

The top wall 18 of the case can also be referred to as a canopy. With reference to FIGS. 3–5, the canopy 18 includes end supports 42 coupled to the top wall 18 and positioned at opposite ends of each segment 40. Alternatively, the end supports 42 could be positioned at the ends of the case 12 only, or at the ends of the case 12 and at various intermediate locations between the ends. The end supports 42 include a lower connecting portion 44 and an upper connecting portion 46. The canopy 18 includes a bottom canopy extrusion 48 extending between and coupled to lower connecting portions 44 of adjacent end supports 42. The canopy 18 also includes an upper canopy extrusion 50 extending between and coupled to upper connecting portions 46 of adjacent end supports 42. The bottom canopy extrusion 48 includes a lower retainer 52 and the upper canopy extrusion 50 includes an upper retainer 54. The lower canopy extrusion 48 is configured to be snap-fit to the lower connecting portions 44 of the end supports 42 and the upper canopy extrusion 50 is configured to be snap-fit to the upper connecting portions 46 of the end supports 42.

Referring back to FIG. 1, the canopy 18 includes three display panels 56 extending across the length of the case 12. In other embodiments, the number of display panels 56 can vary such that a single display panel 56 extends across the entire length of the canopy 18 or two or more than three panels 56 are aligned in a row to extend across the length of the canopy 18. The display panels 56 are generally planar, rectangular sheets of plastic. The display panels 56 can be either transparent or translucent and can include indicia representative of, for example, product or manufacturer information. In other embodiments, some or all of the display panels 56 can be opaque. The display panels 56 each include a slightly bent top edge 58 and a bent bottom edge 60. The top edge 58 is received within the upper retainer 54 and the bottom edge 60 is received within the lower retainer 52.

As shown in FIGS. 3 and 4, the case 12 also includes a light channel 62 coupled to the canopy 18 and a light source 64, such as a fluorescent bulb, coupled to the light channel 62. The light channel 62 can be made from stamped and formed sheet metal. The light channel 62 includes a planar top portion 66 and a front portion 68 that is connected to the front edge of the top portion 66. The front portion 68 extends downwardly from the top portion 66 and is positioned in front of the light source 64. The front and top portions 66, 68 include cutouts 70 allowing the transfer of light through the front and top portions 66, 68 through the cutouts 70. The cutouts 70 are separated from each other by narrow ribs 72 that connect the top and front portions 66, 68. The light channel 62 opens generally toward the product display area 24 in a downward and rearward direction. The portion of the light channel 62 facing the light source 64 can be made of a reflective material.

Figure 6:
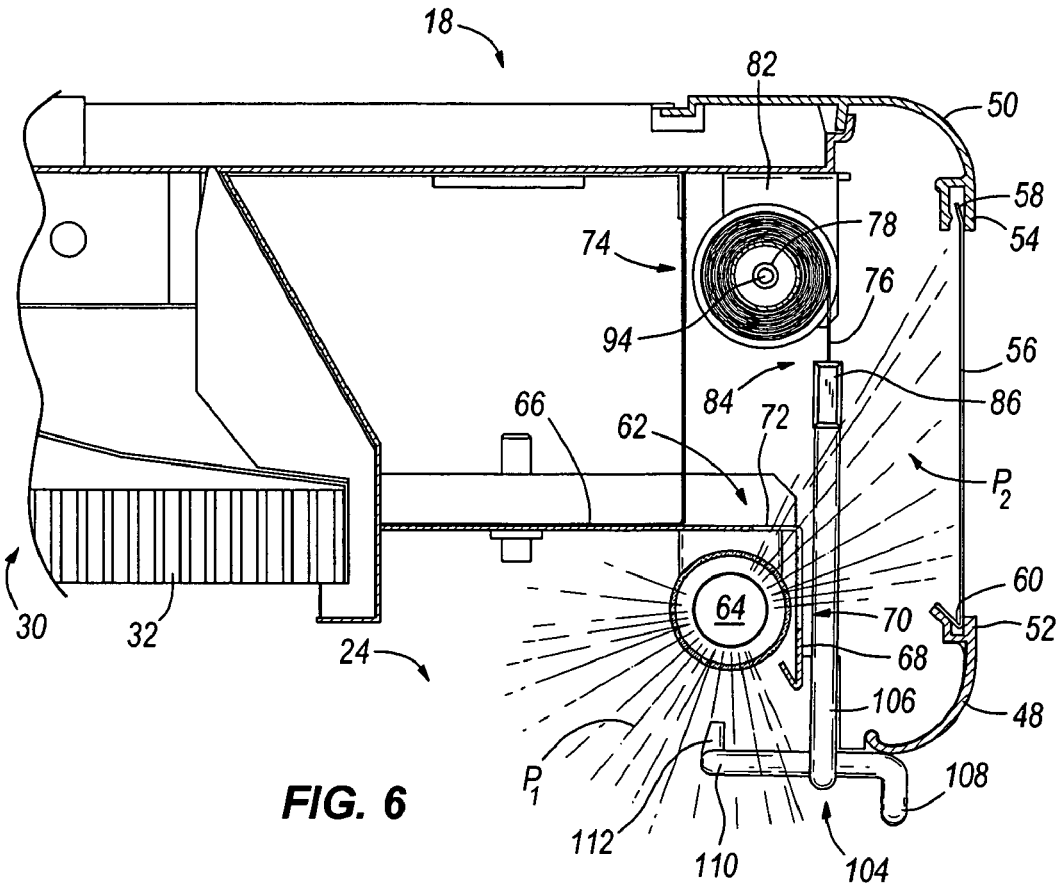
FIG. 6 is an enlarged cross-section view taken along line 6—6 in FIG. 1, illustrating first and second illumination paths.

As illustrated in FIG. 6, the light source 64 projects light along a first path of illumination P1 directed toward the product display area 24 adapted to brighten the food product and projects light along a second path of illumination P2 directed toward the display panel 56 and through the cutouts 70. At least a portion of the light along the second path of illumination P2 passes through the transparent or translucent portions of the display panel 56 to be visible from the front of the display panel 56. In this manner, the single light source 64 provides light to illuminate both the product display area 24 and the display panels 56 in the canopy 18. In some embodiments, the light source 64 is positioned at approximately the height of the bottom edge 60 of the display panel 56.

A path of illumination is defined as the path traveled by light from the light source 64 to a destination surface or item. For example, the first path of illumination P1 is the path traveled by the light from the light source 64 to the products within the product display area 24. As shown in FIG. 6, the path of illumination can spread across an array and need not travel along a single vector. As another example, the second path of illumination P2 is the path traveled by the light from the light source 64 to the rear face of the display panel 56. An object is understood to be in or within the path of illumination when that object is positioned between the light source 64 and the destination surface such that a portion of the light that would have otherwise traveled to the destination surface is reflected or absorbed by the object prior to reaching the destination surface. According to this definition, the ribs 72 of the light channel 62 are considered to be within the second path of illumination P2.

The procedure for removing the display panel 56 is illustrated in FIGS. 3–5. With reference to FIG. 4, the display panel 56 is lifted upward such that the bottom edge 60 is removed from the lower retainer 52. As shown in FIG. 5, after the bottom edge 60 is lifted, the bottom edge 60 can be pivoted forwardly about the top edge 58. After rotation sufficient for the bottom edge 60 to clear the lower retainer 52, the display panel 56 can be lowered to remove the top edge 58 from the upper retainer 54 (FIG. 3). The procedure for installing the display panel 56 into the canopy 18 repeats these same steps in reverse order.

Figure 7:
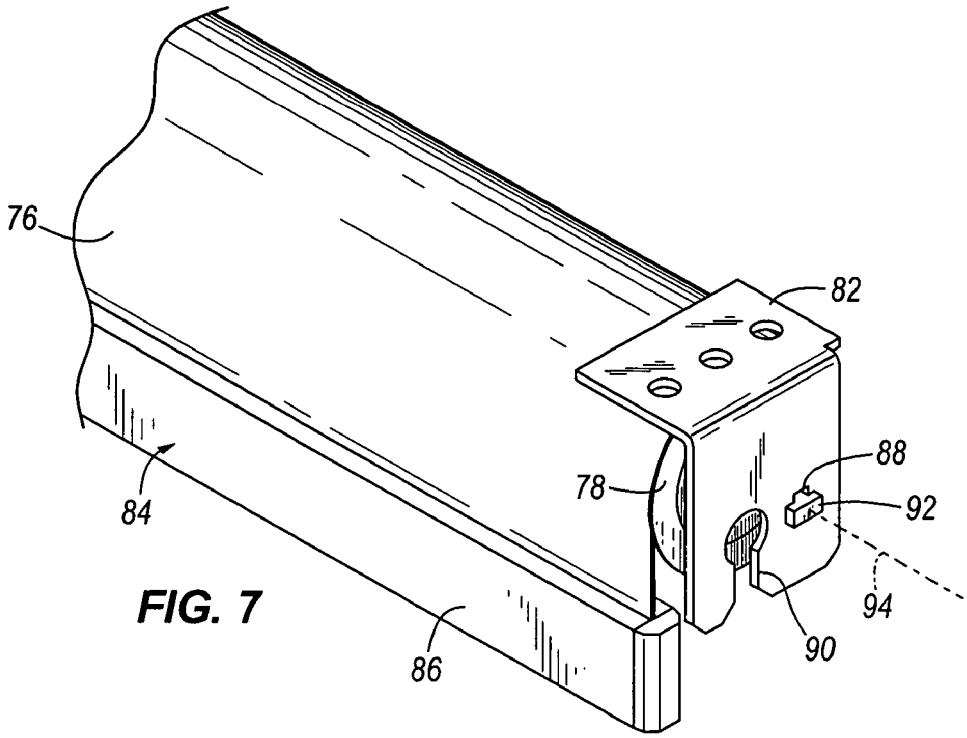
FIG. 7 is an enlarged right side perspective view of a right end portion of a night curtain assembly of the refrigerated display case of FIG. 1.
Figure 8:
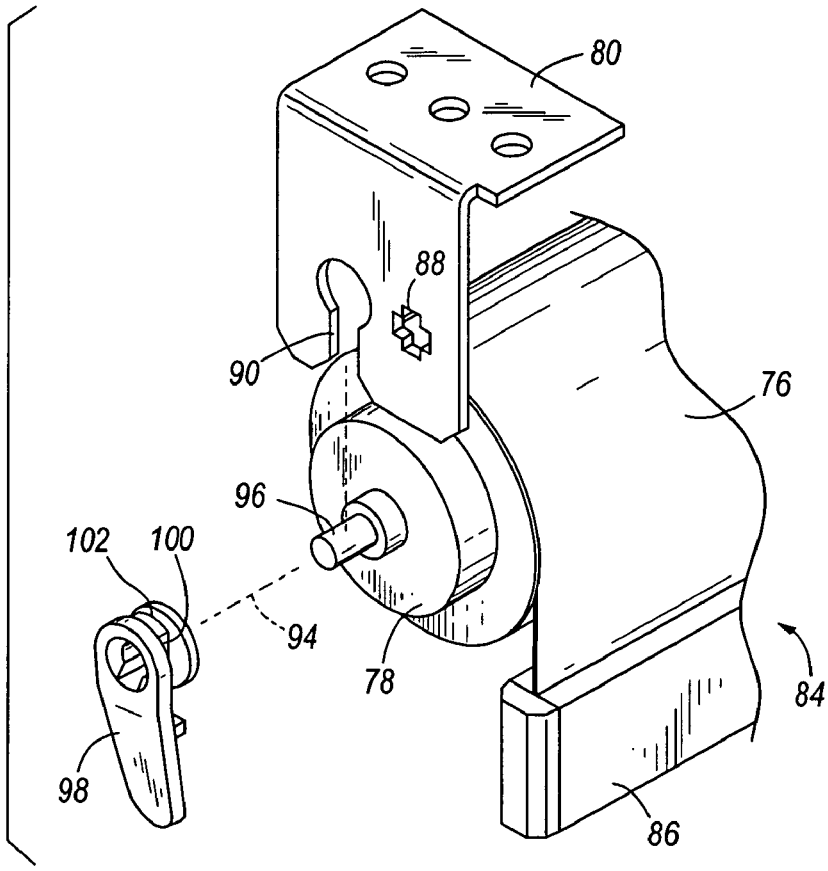
FIG. 8 is a left side perspective view of a left end portion of the night curtain assembly of FIG. 7.
Figure 9:
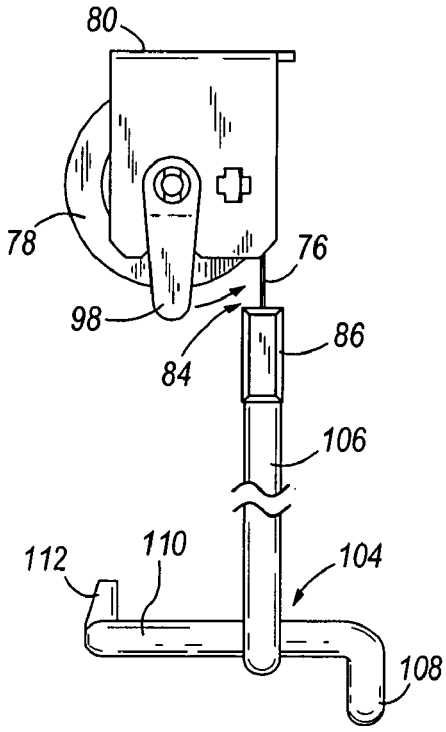
FIG. 9 is a left side view of the night curtain assembly of FIG. 8, illustrating a spindle lock of the night curtain assembly in an unlocked orientation.
Figure 10:
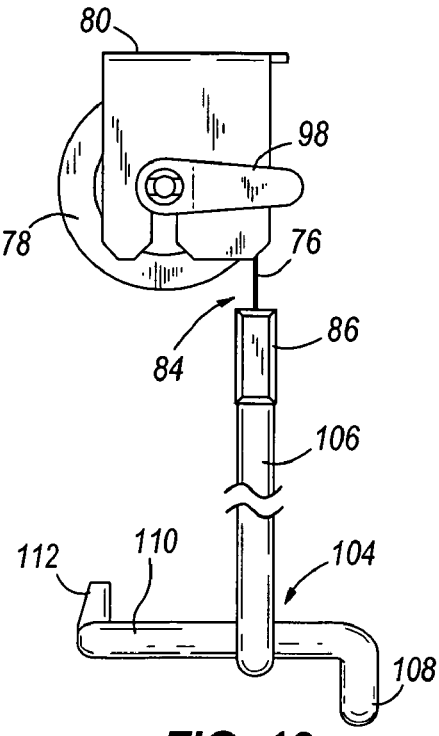
FIG. 10 is a view similar to FIG. 9, illustrating the spindle lock in a locked orientation.

As illustrated in FIGS. 6–8, the refrigerated display case 10 includes a night curtain assembly 74 including a curtain 76 having one end attached to a roll 78 that is rotatably coupled to the canopy 18 through left and right brackets 80, 82. As mentioned above, each segment 40 may include a separate night curtain assembly 74 or a single night curtain assembly 74 can be used across multiple segments. The curtain 76 is wound around the roll 78 positioning a free end 84 of the curtain adjacent the roll 78. The free end 84 of the curtain 76 includes a stay 86, which is a strip of rigid material used to stiffen the free end 84. Each bracket 80, 82 includes a cross-shaped aperture 88 and a keyhole slot 90 opening to the lower edge of the bracket 80, 82. The roll 78 includes a rectangular pin 92 extending from one end of the roll 78 along the axis of rotation 94 of the roll 78 and a cylindrical pin 96 extending from the other end of the roll 78 along the axis of rotation of the roll 78. The rectangular pin 92 is received within the cross-shaped aperture 88 of the right bracket 82. The cylindrical pin 96 is received within a spindle lock 98 that receives the cylindrical pin 96 and that is received within the keyhole slot 90 in a first orientation (FIG. 9). In the first, unlocked orientation, flats 100 within an annular recess 102 are aligned with the edges of the keyhole slot 90 and therefore the spindle lock 98 is allowed to move through the keyhole slot 90. After the spindle lock 98 is fully inserted into the keyhole slot 90, the spindle lock 98 is rotated to a second, locked orientation (FIG. 10). In the second orientation, the flats 100 of the spindle lock 98 are not aligned with the edges of the keyhole slot 90 and therefore restrict the spindle lock 98 from moving out of the keyhole slot 90. In some embodiments, the right and left brackets 80, 82 are substantially identical.

Figure 11:
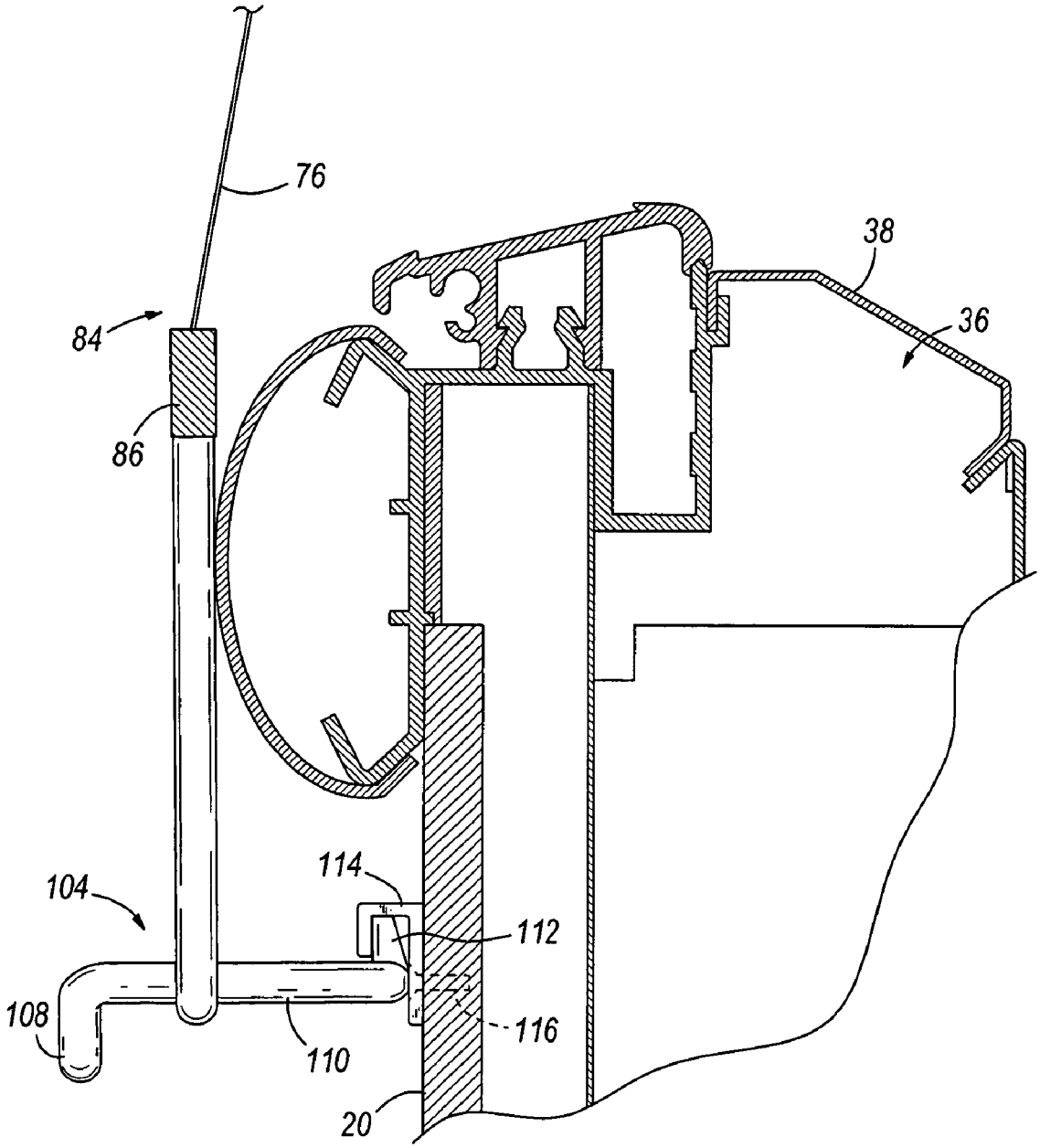
FIG. 11 is a cross-section view taken along line 11—11 in FIG. 2, illustrating a handle of the night curtain assembly releasably coupled to a hook on the refrigerated display case.

As shown in FIG. 3, the night curtain assembly 74 also includes a handle 104 including a connecting portion 106 coupled to and extending between the free edge 84 of the curtain 76 and a grip portion 108 of the handle 104. The grip portion is accessible from the front of the case 12. The handle 104 also includes a rearward portion 110 having an upwardly extending tab 112 (FIG. 11).

The curtain 76 is adjustable between a raised position (FIG. 1) and a lowered position (FIG. 2). In the raised position, the curtain 76 is rolled onto the roll 78 within the canopy 18 and out of the second path of illumination P2 (FIG. 6), or at least effectively out of the second path of illumination P2 such that light projected along the second path of illumination P2 reaches a substantial portion of the of the rearwardly-facing surface of the display panel 56 unobstructed by the curtain 76. In some embodiments, a substantial portion can be at least 90% of the display panel 56, in other embodiments a substantial portion can be at least 80%, and yet other embodiments a substantial portion can be at least 70%.

In the raised position, the grip portion 108 of the handle 108 is positioned adjacent to the bottom canopy extrusion 48 such that it remains accessible even when the curtain 76 is in the raised position. The connecting portion 106 of the handle 104 is positioned within the second path of illumination P2, however the amount of interference caused by the connecting portion 106 is insignificant and does not cause any noticeable unwanted shadow effects on the display panel 56. In some cases, the handle 104 can be formed from a transparent plastic to even further minimize the negligible effect of the interference of the connecting portion 106 with the second path of illumination P2.

To move to the lowered position, the handle 104 is pulled and the curtain 76 is unrolled from the roll 78 into interference with the second path of illumination P2 between the light source 64 and the display panel 56. In the lowered position, the curtain 76 covers a portion of the opening 28 to the product display area 24. The curtain 76 is drawn to the lowered position to better isolate the cooled air of the product display area 24 from the ambient air outside of the refrigerated display case 10. The curtain 76 improves the efficiency of the refrigerated display case 10 while maintaining the food product at the desired temperature when the retail food store is closed (e.g., during nighttime hours), when convenient access to the food products of the product display area 24 is not required.

The roll 78 is biased toward maintaining the curtain 76 in the raised position. As is common for most pull shades, the rectangular pin 92 is held stationary as the roll 78 rotates when the curtain 76 is being pulled downwardly away from the roll 78. In this manner, the spring is wound thereby creating the bias to return the curtain 76 back to the raised position after the handle 104 is released. As shown in FIGS. 1 and 11, the curtain 76 can be secured in the lowered position against the bias of the roll 78 by inserting the tab 112 of the rear portion 110 within a hook 114 that is coupled to the front wall 20 by a fastener 116.

In order to move the nighttime curtain 76 from the raised position to the lowered position, a retailer can reach up and grab the grip portion 108 of the handle 104 and then pull the handle 104 downwardly past the hook 114 located on the front wall 20 of the case 12. The retailer can then insert the tab 112 of the handle 104 into the handle hook 114 and release the handle 104. The bias of the roll 78 will pull the slack from the curtain 76 and the tab 112 will remain within the hook 114. When the night curtain 76 is to be returned to the raised position, the retailer can pull the handle 104 downwardly out of contact with the hook 114 and then raise the handle 104 back toward the canopy 18. During this motion, the roll 78 will rotate under bias to rewind the curtain 76 back onto the roll 78. The retailer can release the handle 104 after the curtain 76 is returned to the raised position and the bias of the roll 78 will maintain the curtain 76 in the raised position.

Various features and advantages of the invention are set forth in the following claims.

What is claimed is:

1. A refrigerated display case for maintaining food product at a desired temperature, the refrigerated display case comprising:

a case including a product display area adapted to support and display the food product to be visible from the front of the case, and a canopy positioned above the product display area and having at least one display panel;

a refrigeration system supplying refrigerated air to the product display area and adapted to maintain the food product at the desired temperature;

a light source supported by the case between the product display area and the display panel, the light source projecting light along a first path of illumination directed toward the product display area adapted to brighten the food product, and the light source projecting light along a second path of illumination directed toward the display panel, at least a portion of the light along the second path of illumination passing through the display panel to be visible from the front of the display; and a light channel coupled to the case and at least partially surrounding the light source, the channel being open in the direction of the first path of illumination and the channel including cutouts allowing light to pass in the direction of the second path of illumination.

2. The refrigerated display case of claim 1, wherein the channel is formed from sheet metal.

3. The refrigerated display case of claim 1, wherein the canopy is located near the top of the case, and wherein the light source is positioned above the product display area and behind the display panel.

4. The refrigerated display case of claim 3, wherein the first path of illumination is directed generally downward and rearward and the second path of illumination is directed generally upward and forward.

5. The refrigerated display case of claim 3, wherein the canopy includes upper and lower retainers coupled to the case, the upper and lower retainers releasably coupling upper and lower edges, respectively, of the display panel.

6. A refrigerated display case for maintaining food product at a desired temperature, the refrigerated display case comprising:

a case including a product display area adapted to support and display the food product to be visible from the front of the case, a canopy positioned above the product display area and having at least one display panel, the canopy located near the top of the case and including upper and lower retainers coupled to the case, the upper and lower retainers releasably coupling upper and lower edges, respectively, of the display panel, and end supports coupled to the case and separated a distance from each other, the upper and lower retainers coupled to the end supports and extending between the end supports;

a refrigeration system supplying refrigerated air to the product display area and adapted to maintain the food product at the desired temperature; and a light source supported by the case between the product display area and the display panel, and further positioned above the product display area and behind the display panel, the light source projecting light along a first path of illumination directed toward the product display area adapted to brighten the food product, and the light source projecting light along a second path of illumination directed toward the display panel, at least a portion of the light along the second path of illumination passing through the display panel to be visible from the front of the display panel.

7. The refrigerated display case of claim 6, wherein the display panel includes a rearwardly-facing surface, and wherein light projects along the second path of illumination to reach a substantial portion of the of the rearwardly-facing surface.

8. The refrigerated display case of claim 1, wherein the product display area is adapted to display the food product to be visible and accessible from an opening in the front of the case, wherein the refrigerated display case further comprises a curtain coupled to the case, the curtain being adjustable between a raised position where the curtain is rolled and out of the second path of illumination and a lowered position where the curtain is unrolled and within the second path of illumination between the light source and the display panel, the curtain in the lowered position covering a portion of the opening to the product display area.

9. A refrigerated display case for maintaining food product at a desired temperature, the refrigerated display case comprising:

a case including a product display area adapted to support and display the food product to be visible and accessible from an opening in the front of the case, and a canopy positioned above the product display area and having at least one display panel;

a refrigeration system supplying refrigerated air to the product display area and adapted to maintain the food product at the desired temperature;

a light source supported by the case, the light source projecting light along a path of illumination directed toward the display panel, at least a portion of the light along the path of illumination passing through the display panel to be visible from the front of the display panel; and a curtain coupled to the case, the curtain being adjustable between a raised position where the curtain is rolled and out of the path of illumination and a lowered position where the curtain is unrolled and within the path of illumination between the light source and the display panel, the curtain in the lowered position covering a portion of the opening to the product display area.

10. The refrigerated display case of claim 9, further comprising a handle coupled to an edge of the curtain, wherein a portion of the handle is accessible from the front of the case when the curtain is in the raised position.

11. The refrigerated display case of claim 10, wherein the handle includes a grip portion and a connecting portion coupled to and extending between the edge of the curtain and the grip portion.

12. The refrigerated display case of claim 11, wherein the grip portion is out of the path of illumination and the connecting portion is within the path of illumination when the curtain is in the raised position.

13. The refrigerated display case of claim 9, wherein the curtain is biased to be in the raised position.

14. The refrigerated display case of claim 9, wherein the curtain is rolled onto a roll rotatably coupled to the case about an axis of rotation, the roll having a cylindrical pin extending from one end and a rectangular pin extending from the opposite side, the cylindrical and rectangular pin substantially collinear with the axis of rotation of the roll.

15. The refrigerated display case of claim 14, further comprising a right bracket coupled to the case and a left bracket coupled to the case, each bracket including a cross-shaped opening and a keyhole slot, wherein the rectangular pin is received within the cross-shaped opening of one of the right and left brackets and the cylindrical pin is received within the keyhole slot of the other of the right and left brackets.

16. The refrigerated display case of claim 15, wherein the cylindrical pin is secured within the keyhole slot with a spindle lock that receives the cylindrical pin and is received within the keyhole slot.

17. The refrigerated display case of claim 16, wherein the spindle lock is movable through the keyhole slot in a first orientation and is restrained from movement through the keyhole slot in a second orientation.

18. The refrigerated display case of claim 9, wherein the light source projects light along an additional path of illumination directed toward the product display area adapted to brighten the food product.

19. A refrigerated display case for maintaining food product at a desired temperature, the refrigerated display case comprising:

a case including a product display area adapted to support and display the food product to be visible and accessible from an opening in the front of the case, and a canopy positioned above the product display area and having at least one display panel;

a refrigeration system supplying refrigerated air to the product display area and adapted to maintain the food product at the desired temperature;

a light source supported by the case between the product display area and the display panel, the light source projecting light along a first path of illumination directed toward the product display area adapted to brighten the food product, and the light source projecting light along a second path of illumination directed toward the display panel, at least a portion of the light along the second path of illumination passing through the display panel to be visible from the front of the display panel; and a curtain coupled to the case, the curtain being adjustable between a raised position where the curtain is rolled and out of the path of illumination and a lowered position where the curtain is unrolled and within the path of illumination between the light source and the display panel, the curtain in the lowered position covering a portion of the opening to the product display area.

* * * * *